US007055485B1

(12) United States Patent
Davis et al.

(10) Patent No.: US 7,055,485 B1
(45) Date of Patent: Jun. 6, 2006

(54) MONOBLOCK INTERNAL COMBUSTION ENGINE

(75) Inventors: Richard A. Davis, Mequon, WI (US); Tamotsu Hamanaka, Saitama (JP)

(73) Assignees: Brunswick Corporation, Lake Forest, IL (US); Tohatsu Corporation (JP)

( * ) Notice: Subject to any disclaimer, the term of this patent is extended or adjusted under 35 U.S.C. 154(b) by 0 days.

(21) Appl. No.: 11/121,423

(22) Filed: May 4, 2005

(51) Int. Cl.
*F02F 7/00* (2006.01)

(52) U.S. Cl. ..... 123/195 R

(58) Field of Classification Search ..... 123/195 R, 123/41.82 R, 193.3
See application file for complete search history.

(56) References Cited

U.S. PATENT DOCUMENTS 4,092,956 A * 6/1978 List et al. ..... 123/41.74
4,213,440 A * 7/1980 Abe et al. ..... 123/195 C
4,446,828 A * 5/1984 Bauder et al. ..... 123/196 R
4,606,304 A * 8/1986 Kruger et al. ..... 123/90.27
4,984,539 A * 1/1991 Shinoda et al. ..... 123/41.42
5,143,033 A * 9/1992 Catterson et al. ..... 123/195 R
6,223,713 B1 * 5/2001 Moorman et al. ..... 123/196 R
2002/0056430 A1 * 5/2002 Matsuda et al. ..... 123/90.64

* cited by examiner

*Primary Examiner*—Noah P. Kamen
(74) *Attorney, Agent, or Firm*—Andrus, Sceales, Starke & Sawall, LLP

(57) ABSTRACT

An internal combustion engine includes a cylinder block journaling a crankshaft driven to rotate by a reciprocal piston, and a cylinder head having intake and exhaust passages for delivering a combustible fuel-air mixture to drive the piston and for exhausting the combustion products thereof, respectively. The cylinder block and the cylinder head are a single unitary monoblock member without opposing machined surfaces and a head gasket therebetween.

9 Claims, 7 Drawing Sheets

MONOBLOCK INTERNAL COMBUSTION ENGINE

BACKGROUND AND SUMMARY

The invention relates to internal combustion engines.

An internal combustion engine has a cylinder block journaling a crankshaft driven to rotate by a reciprocal piston. The engine further includes a cylinder head having intake and exhaust passages for delivering a combustible fuel-air mixture to drive the piston and for exhausting the combustion products thereof, respectively. The cylinder block and the cylinder head mate at a pair of opposed machined surfaces having a head gasket therebetween.

The present invention arose during continuing development efforts directed toward simplified, lower cost engine design.

DETAILED DESCRIPTION

Figure 1:
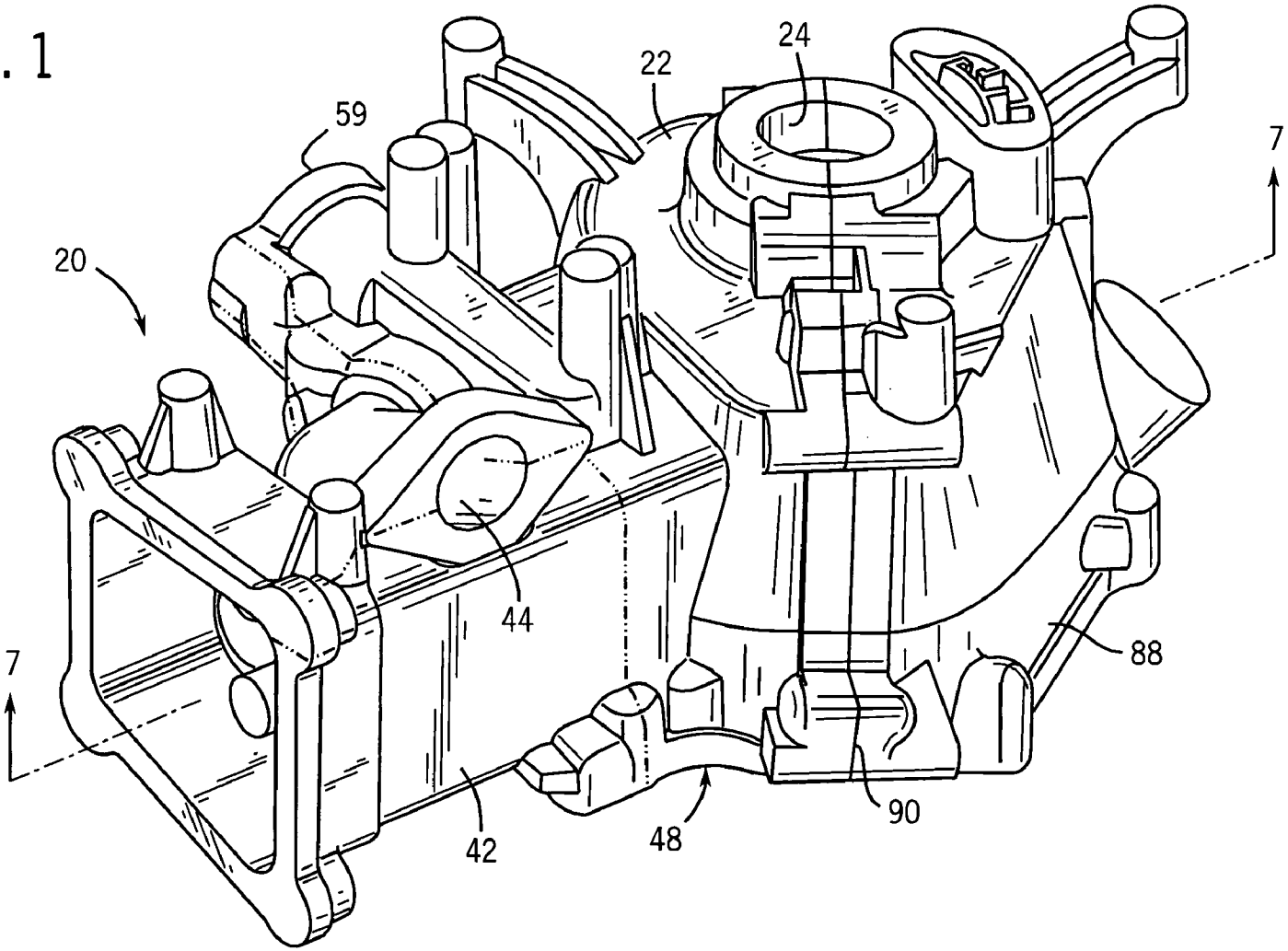
FIG. 1 is a perspective view of an internal combustion engine constructed in accordance with the invention.
Figure 2:
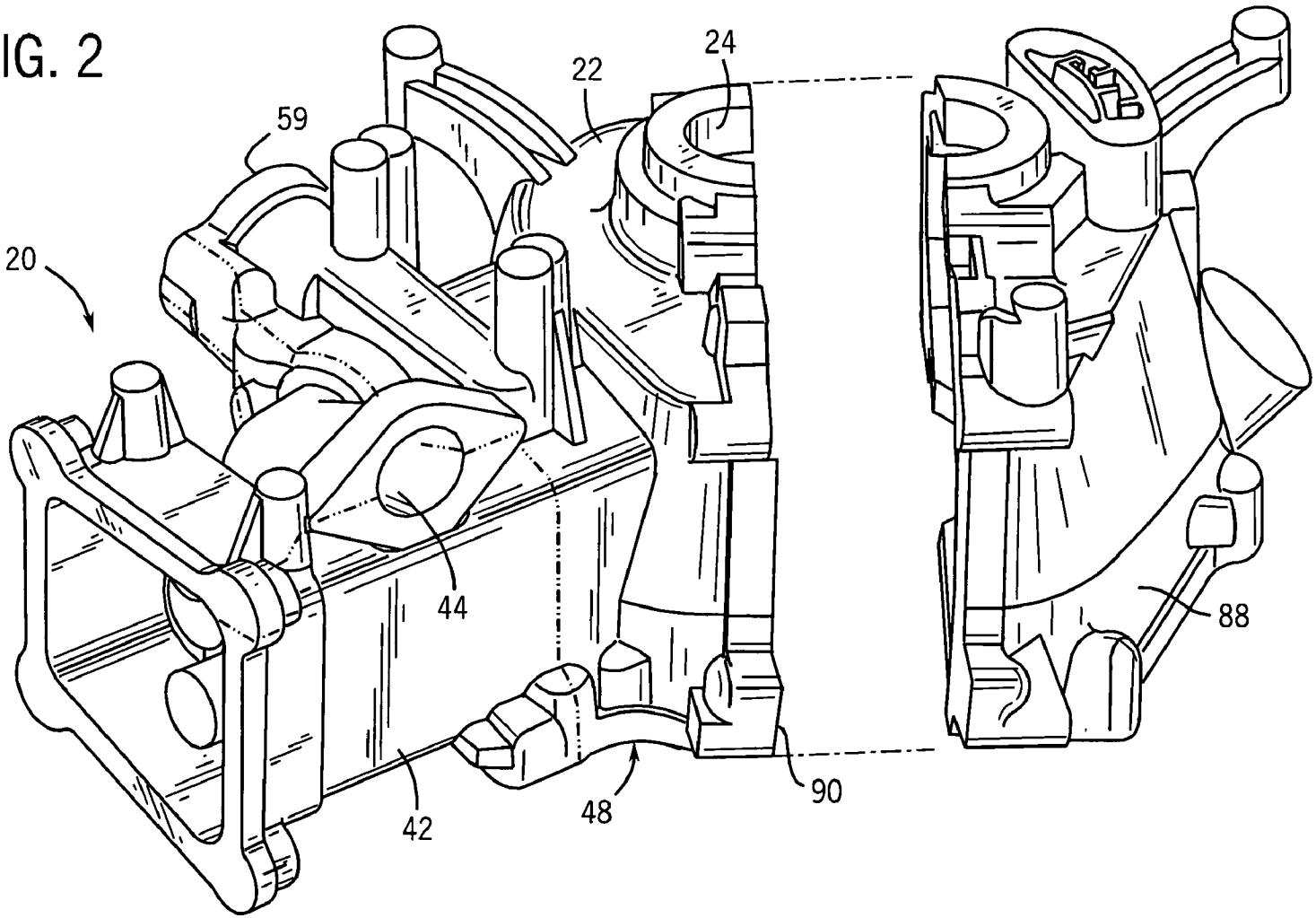
FIG. 2 is an exploded perspective view of the engine of FIG. 1.
Figure 3:
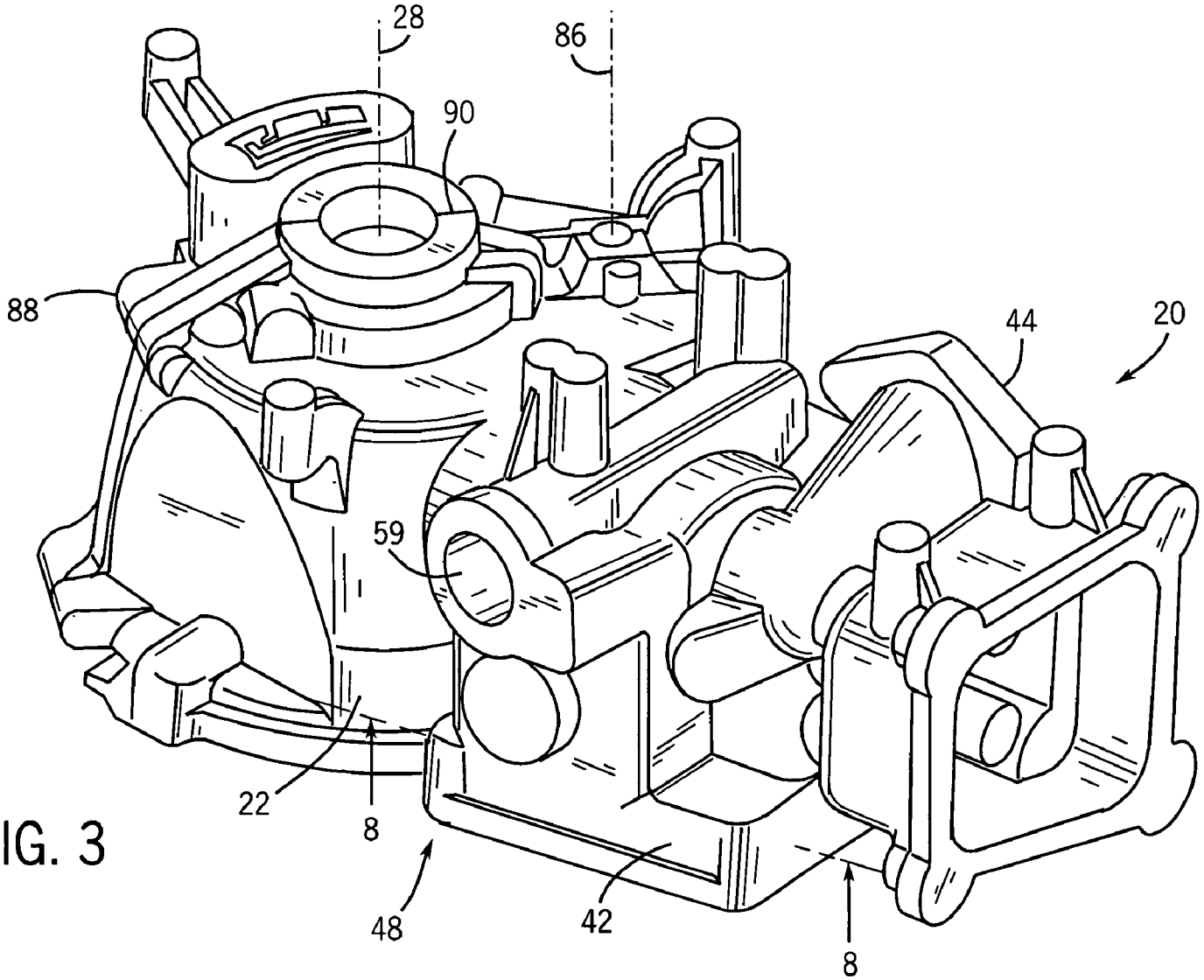
FIG. 3 is a perspective view from a different angle of the engine of FIG. 1.
Figure 4:
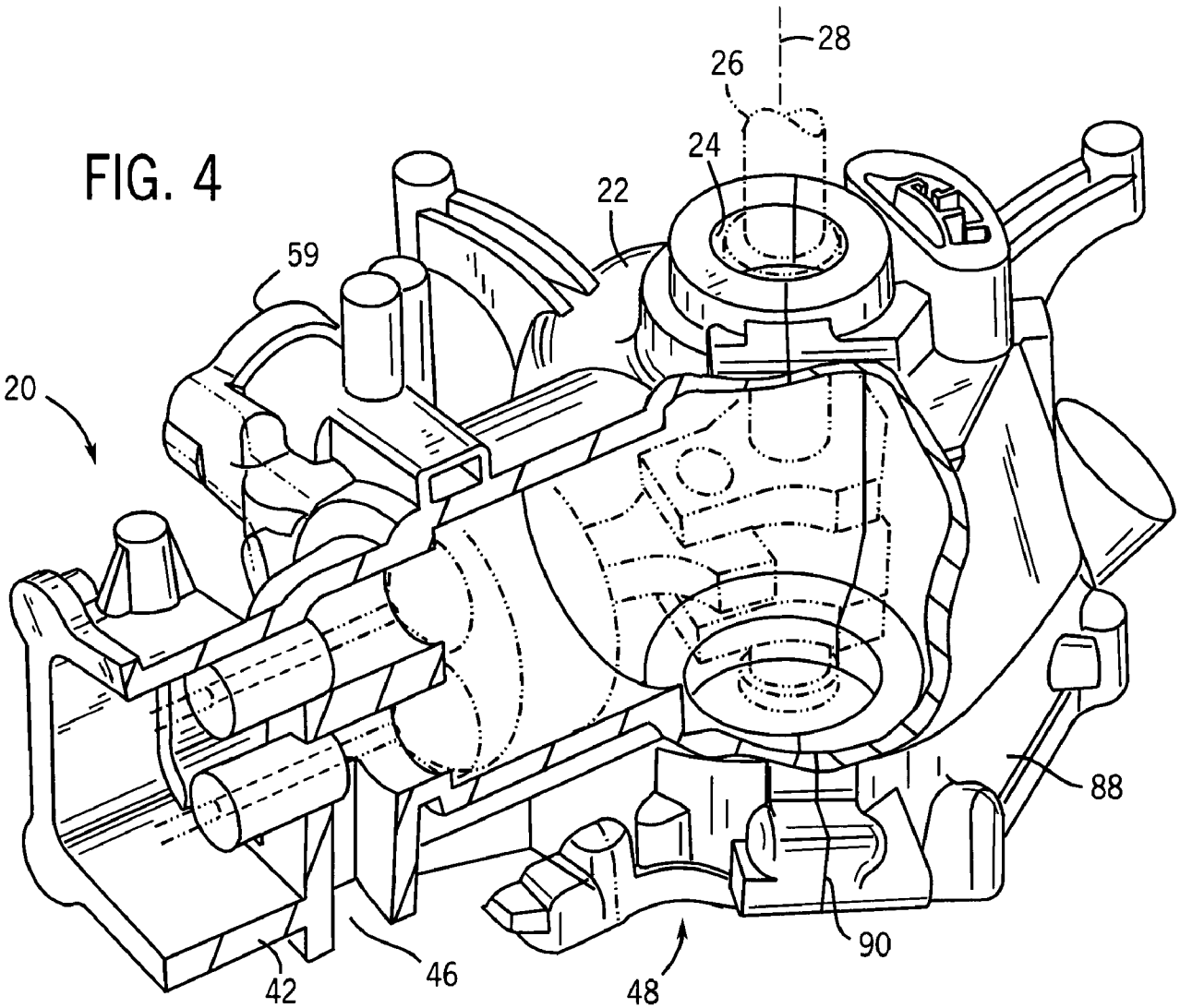
FIG. 4 is a view like FIG. 1 partially cut away.
Figure 6:
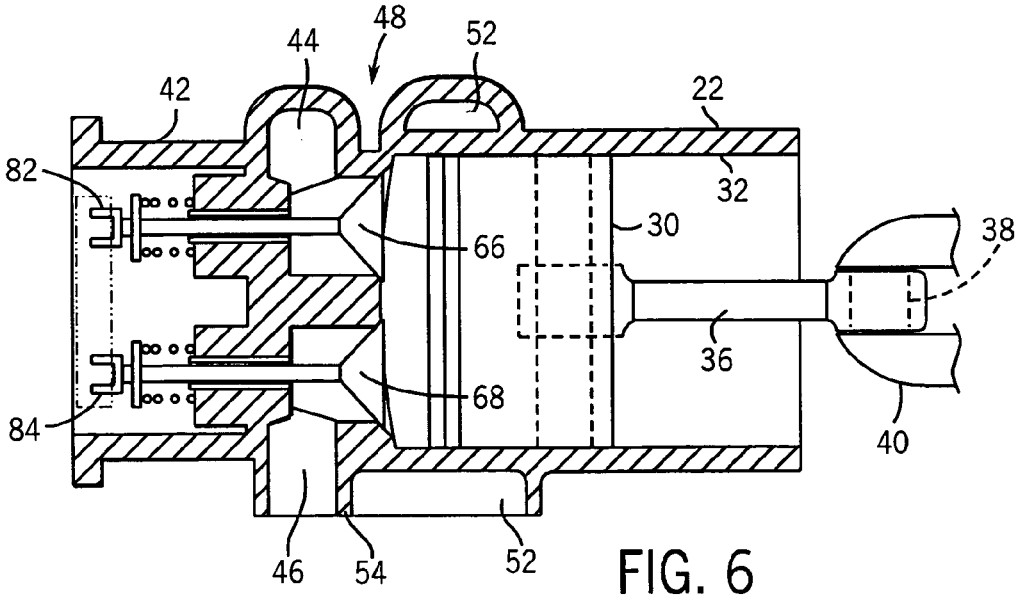
FIG. 6 is like FIG. 5 and illustrates the present invention.
Figure 7:
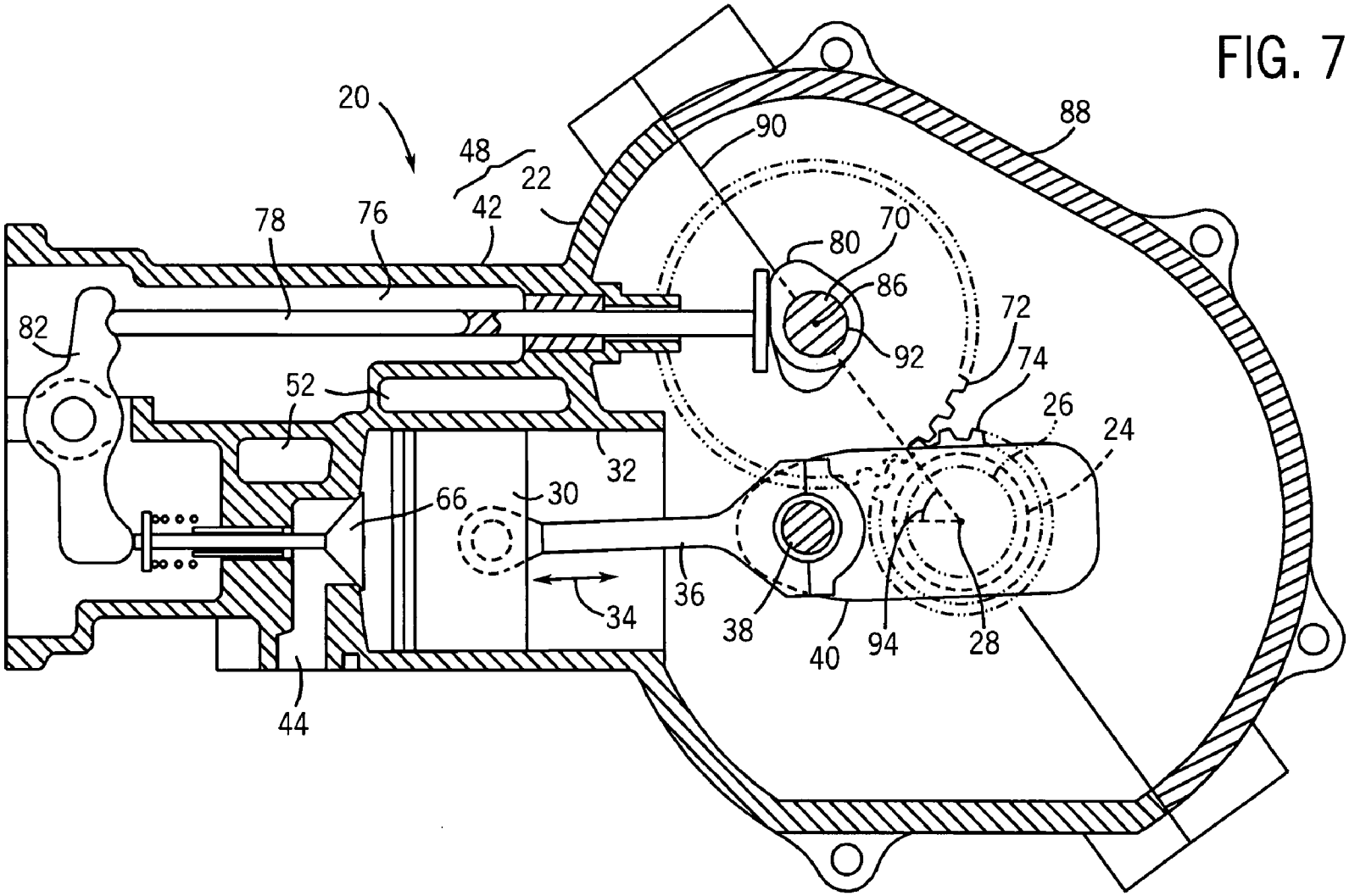
FIG. 7 is a sectional view taken along line 7—7 of FIG. 1.
Figure 8:
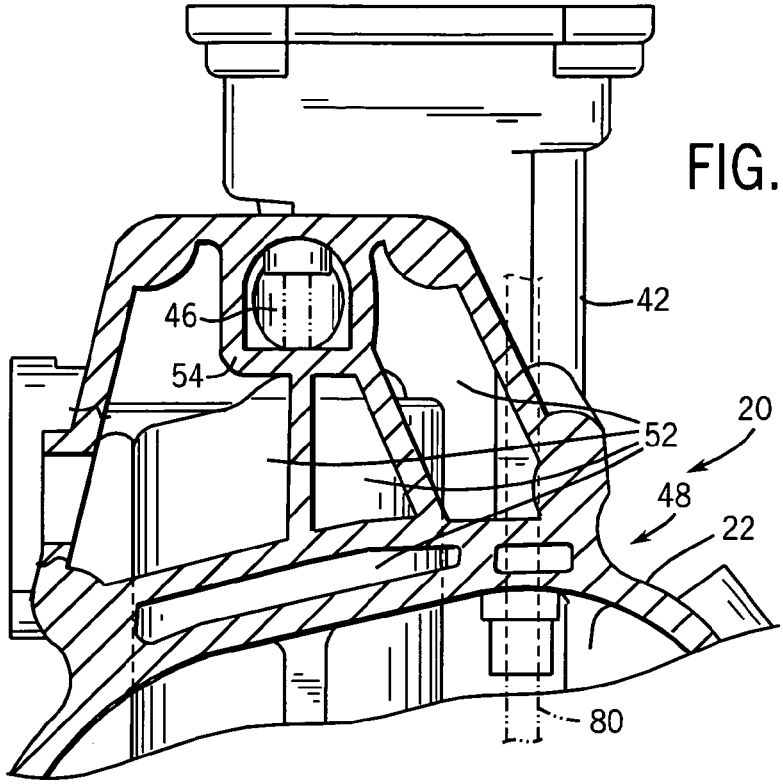
FIG. 8 is a sectional view taken along line 8—8 of FIG. 3.

FIGS. 1–4 show an internal combustion engine 20 including a cylinder block 22 journaling at 24 a crankshaft 26, FIGS. 4, 7, driven to rotate about rotation axis 28 by a reciprocal piston 30 reciprocating within cylinder 32 along reciprocation axis 34 and having connecting rod 36 journaled at 38 to crank rod 40 of crankshaft 26, as is known. Cylinder head 42 has intake and exhaust passages 44 and 46 for delivering a combustible fuel-air mixture to drive piston 30 and for exhausting the combustion products thereof, respectively, as is known. Cylinder block 22 and cylinder head 42 are a single unitary monoblock member 48, FIG. 7, without opposing machined surfaces and a head gasket therebetween. This is in contrast to the prior art, FIG. 5, wherein cylinder block 22*a* and cylinder head 42*a* have opposing machined surfaces 22*b* and 42*b* and a head gasket 50 therebetween. Intake and exhaust passages 44*a* and 46*a* are in cylinder head 42*a*. In contrast, in FIG. 6, cylinder block 22 and cylinder head 42 are a single unitary monoblock member 48 without the noted opposing machined surfaces and head gasket therebetween. Cylinder block 22 and cylinder head 42 are preferably a single unitary die cast member 48.

In one embodiment, engine 20 is liquid cooled by liquid coolant in one or more cooling passages 52 integrally formed with cylinder head 42 and cylinder block 22 all as a single unitary monoblock member. In a preferred embodiment, exhaust passage 46 and one or more cooling passages 52 share a common cylinder head wall 54 therebetween, FIG. 9, the common cylinder head wall 54 having a first surface 56 facing exhaust passage 46, and having a second surface 58 distally oppositely facing cooling passage 52. A thermostat opening 59 may be provided if desired.

Figure 9:
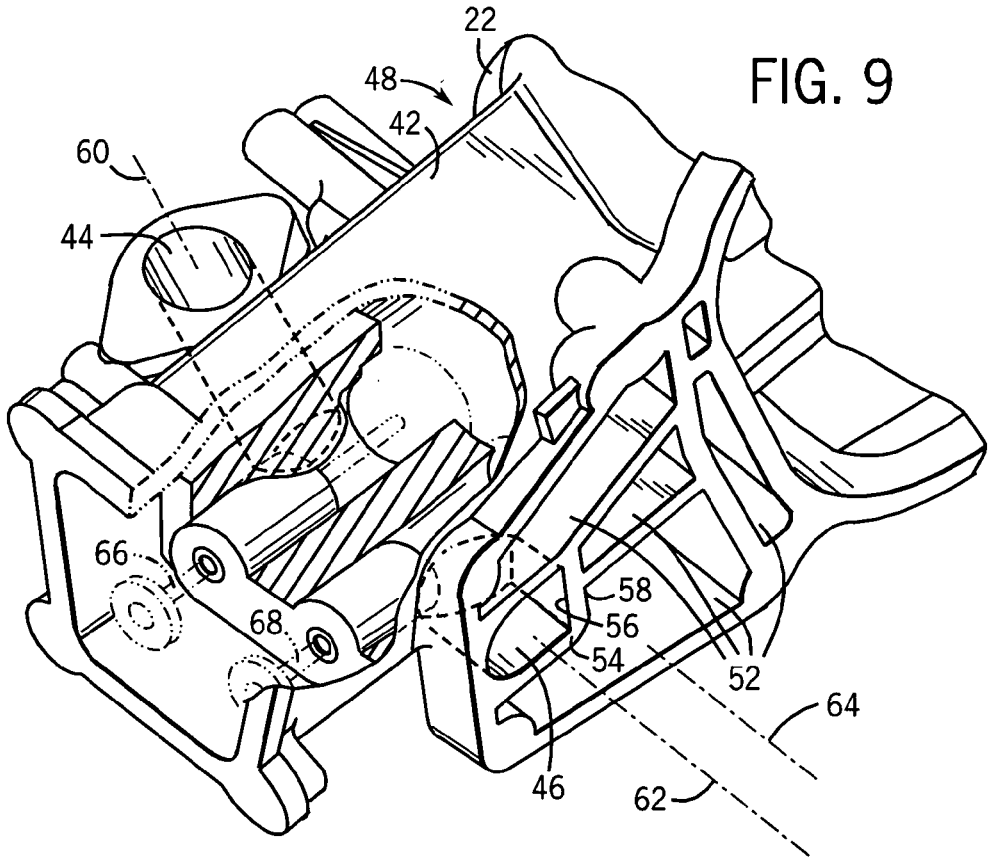
FIG. 9 is a perspective view partially cut away of the construction of FIG. 8.

In a further preferred embodiment, each of the intake and exhaust passages 44 and 46 extends along a direct die pull path 60 and 62, respectively, FIG. 9, enabling direct die pull cores to integrally form intake and exhaust passages 44 and 46 with the cylinder head and cylinder block. Cooling passage 52 extends along a direct die pull path 64 enabling a direct die pull core to integrally form cooling passage 52 with the cylinder head and cylinder block. Exhaust passage 46 and cooling passage 52 are die pulled in a common direction 62, 64. Intake passage 44 may be die pulled in a different direction 60 than the common direction 62, 64 of die pulling of the exhaust passage 46 and the cooling passage 52.

Figure 5:
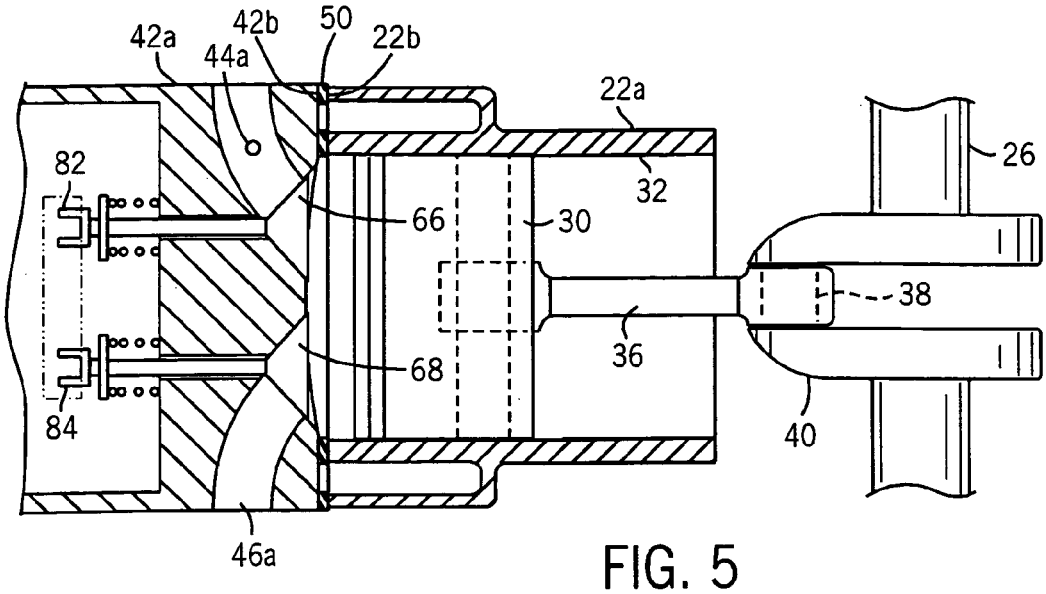
FIG. 5 PRIOR ART
FIG. 5 is a schematic sectional view illustrating prior art.

In one embodiment, the engine is a four-stroke internal combustion engine having intake and exhaust valves 66 and 68, FIG. 6, for delivering a combustible fuel-air mixture to drive piston 30 and for exhausting the combustion products thereof, respectively, as is known, FIG. 5. Intake and exhaust passages 44 and 46 are integrally formed with the cylinder head and cylinder block forming monoblock member 48 and lead to and from intake and exhaust valves 66 and 68, respectively. The cylinder block journals a camshaft 70, FIG. 7, driven to rotate by crankshaft 26 by respective gears 72 and 74. The cylinder head has a pushrod passage 76 integrally formed with the cylinder head and cylinder block and receiving a pair of pushrods 78 and 80 driven by camshaft 70 at cam lobes such as 80 for actuating respective intake and exhaust valves 66 and 68 through respective rocker arms 82 and 84, as is known. Piston 30 reciprocates along reciprocation axis 34. Pushrod passage 76 extends parallel to reciprocation axis 34 and is laterally spaced therefrom along a first lateral direction. Intake and exhaust passages 44 and 46 integrally formed with the cylinder head and cylinder block are laterally spaced, FIG. 9, on opposite lateral sides of the pushrod passage along a second lateral direction transverse to the noted first lateral direction. Crankshaft 26 rotates about a first rotation axis 28 transverse to reciprocation axis 34. Camshaft 70 rotates about a second rotation axis 86 parallel to first rotation axis 28 and transverse to reciprocation axis 34. A crankcase 88, FIG. 7, is mounted to cylinder block 22 along a mating interface 90 lying along an oblique plane relative to reciprocation axis 34. The noted oblique plane contains each of the noted first and second rotation axes 28 and 86 lying therealong. Mating interface 90 contains a first set of journals 24 journaling crankshaft 26 to the interface of cylinder block 22 and crankcase 88. Mating interface 90 contains a second set of journals 92 journaling camshaft 70 to the interface of cylinder block 22 and crankcase 88. The noted oblique plane along interface 90 extends from first rotation axis 28 toward second rotation axis 86 along an angle angled toward piston 30, FIG. 7, and preferably forms an acute included angle 94 with reciprocation axis 34.

It is recognized that various equivalents, alternatives and modifications are possible within the scope of the appended claims.

What is claimed is:

1. An internal combustion engine comprising a cylinder block journaling a crankshaft driven to rotate by a reciprocal piston, and a cylinder head having intake and exhaust passages for delivering a combustible fuel-air mixture to drive said piston and for exhausting the combustion products thereof, respectively, said cylinder block and said cylinder head being a single unitary monoblock member without opposing machined surfaces and a head gasket therebetween, wherein said engine is liquid cooled, said engine is cooled by liquid coolant in a cooling passage integrally formed with said cylinder head and said cylinder block all as a single unitary monoblock member, each of said intake and exhaust passages extends along a direct die pull path enabling direct die pull cores to integrally form said intake and exhaust passages with said cylinder head and cylinder block, said cooling passage extends along a direct die pull path enabling a direct die pull core to integrally form said cooling passage with said cylinder head and cylinder block, said exhaust passage and said cooling passage are die pulled in a common direction.

2. The internal combustion engine according to claim 1 wherein said intake passage is die pulled in a direction different than said common direction of die pulling of said exhaust and cooling passages.

3. A four-stroke internal combustion engine comprising a cylinder block journaling a crankshaft driven to rotate by a reciprocal piston, and a cylinder head having intake and exhaust valves for delivering a combustible fuel-air mixture to drive said piston and for exhausting the combustion products thereof, respectively, said cylinder block and said cylinder head being a single unitary monoblock member without opposing machined surfaces and a head gasket therebetween, said engine is liquid cooled, said engine is cooled by liquid coolant in a cooling passage integrally formed with said cylinder head and cylinder block all as a single unitary monoblock member, said cylinder block journals a camshaft driven to rotate by said crankshaft, and said cylinder head has a pushrod passage integrally formed with said cylinder head and cylinder block and receiving a pair of pushrods driven by said camshaft for respectively actuating said intake and exhaust valves, said piston reciprocates along a reciprocation axis, said pushrod passage extends axially parallel to said reciprocation axis and is laterally spaced therefrom along a first lateral direction, and wherein said cylinder block has intake and exhaust passages integrally formed with said cylinder head and cylinder block and laterally spaced on opposite lateral sides of said pushrod passage along a second lateral direction transverse to said first lateral direction.

4. A four-stroke internal combustion engine comprising a cylinder block journaling a crankshaft driven to rotate by a reciprocal piston, and a cylinder head having intake and exhaust valves for delivering a combustible fuel-air mixture to drive said piston and for exhausting the combustion products thereof, respectively, said cylinder block and said cylinder head being a single unitary monoblock member without opposing machined surfaces and a head gasket therebetween, said engine is liquid cooled, said engine is cooled by liquid coolant in a cooling passage integrally formed with said cylinder head and cylinder block all as a single unitary monoblock member, said cylinder head has intake and exhaust passages integrally formed with said cylinder head and cylinder block, each of said intake and exhaust passages extending along a direct die pull path enabling direct die pull cores to integrally form said intake and exhaust passages with said cylinder head and cylinder block, said cooling passage extends along a direct die pull path enabling a direct die pull core to integrally form said cooling passage with said cylinder head and cylinder block, said exhaust passage and said cooling passage are die pulled in a common direction.

5. The four-stroke internal combustion engine according to claim 4 wherein said intake passage is die pulled in a direction different than said common direction of die pulling of said exhaust and cooling passages.

6. A four-stroke internal combustion engine comprising a cylinder block journaling a crankshaft driven to rotate by a reciprocal piston, and a cylinder head having intake and exhaust valves for delivering a combustible fuel-air mixture to drive said piston and for exhausting the combustion products thereof, respectively, said cylinder block and said cylinder head being a single unitary monoblock member without opposing machined surfaces and a head gasket therebetween, said engine is liquid cooled, said engine is cooled by liquid coolant in a cooling passage integrally formed with said cylinder head and cylinder block all as a single unitary monoblock member, said piston reciprocates along a reciprocation axis, said cylinder block journals a camshaft driven to rotate by said crankshaft, said crankshaft rotates about a first rotation axis transverse to said reciprocation axis, said camshaft rotates about a second rotation axis parallel to said first rotation axis and transverse to said reciprocation axis, and comprising a crankcase mounted to said cylinder block along a mating interface lying along an oblique plane relative to said reciprocation axis, said oblique plane containing each of said first and second rotation axes lying therealong.

7. The four-stroke internal combustion engine according to claim 6 wherein said mating interface contains a first set of journals journaling said crankshaft to said interface of said cylinder block and said crankcase, and said mating interface contains a second set of journals journaling said camshaft to said interface of said cylinder block and said crankcase.

8. The four-stroke internal combustion engine according to claim 6 wherein said camshaft drives a pair of pushrods for respectively actuating said intake and exhaust valves, and said oblique plane extends from said first rotation axis toward said second rotation axis along an angle angled toward said piston.

9. The four-stroke internal combustion engine according to claim 8 wherein said oblique plane extending from said first rotation axis toward said second rotation axis forms an acute included angle with said reciprocation axis.

* * * * *